US007762308B2

(12) United States Patent
Crawford et al.

(10) Patent No.: US 7,762,308 B2
(45) **Date of Patent: *Jul. 27, 2010**

(54) CAST PARTS WITH IMPROVED SURFACE PROPERTIES AND METHODS FOR THEIR PRODUCTION

(75) Inventors: William A. Crawford, Cincinnati, OH (US); Tracy J. Potter, Philipsburg, PA (US); Donald F. Heaney, Philipsburg, PA (US); Brain S. DeForce, Port Matilda, PA (US); Samardh Onukuri, Cincinnati, OH (US)

(73) Assignee: Ethicon Endo-Surgery, Inc., Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/949,262

(22) Filed: Dec. 3, 2007

(65) Prior Publication Data

US 2008/0121365 A1 May 29, 2008

Related U.S. Application Data

(63) Continuation of application No. 11/536,149, filed on Sep. 28, 2006, now Pat. No. 7,302,993.

(51) Int. Cl.
*B22D 13/00* (2006.01)

(52) U.S. Cl. ..... 164/114; 164/118; 164/133

(58) Field of Classification Search ..... 164/133, 164/113, 114, 118, 520, 529, 119, 306
See application file for complete search history.

(56) References Cited

U.S. PATENT DOCUMENTS 2,385,631 A * 9/1945 Levinson ..... 164/290
2,417,663 A * 3/1947 Rubissow ..... 164/290

(Continued)

FOREIGN PATENT DOCUMENTS

EP 0 212 929 3/1987

(Continued)

OTHER PUBLICATIONS

Atwood, C.L., "Metal Casting Applications," JTEC/WTEC Panel Report on Rapid Prototyping in Europe and Japan, v.1, ch.10 (1997).

(Continued)

*Primary Examiner*—Kuang Lin
(74) *Attorney, Agent, or Firm*—Nutter McClennan & Fish LLP

(57) ABSTRACT

Techniques for forming cast parts for medical devices suitable for contact with internal regions of patients are described herein. Such parts can be small in scale (e.g., having a major axis less than 0.3 inches, and/or a minor axis less than about 0.08 inches), and can be formed from metals that have a high melting point and high reactivity with environmental components or mold surfaces, such as stainless steel and titanium alloys. Such techniques can include injecting molten metal into the sprue of a mold tree such that the side runners are backfilled after the molten metal impacts a closed end of the sprue. Side runners can be oriented in particular directions and positions to promote backfilling. As well, flask temperatures and the use of surfactants can also promote cast part formation, hindering the formation of surface defects.

19 Claims, 8 Drawing Sheets

U.S. PATENT DOCUMENTS

| | | | | |
|---|---|---|---|---|
| 4,008,749 | A * | 2/1977 | Bellocci et al. | 164/66.1 |
| 5,564,492 | A | 10/1996 | Preiss | |
| 5,678,636 | A | 10/1997 | Preiss | |
| 5,799,386 | A | 9/1998 | Ingersoll et al. | |
| 5,906,234 | A | 5/1999 | Mastrorio et al. | |
| 5,927,379 | A * | 7/1999 | Yasrebi et al. | 164/518 |
| 5,976,457 | A | 11/1999 | Amaya et al. | |
| 6,394,944 | B1 | 5/2002 | Hyllberg et al. | |
| 6,447,295 | B1 | 9/2002 | Kumar et al. | |
| 6,705,385 | B2 | 3/2004 | Ray et al. | |
| 6,755,239 | B2 * | 6/2004 | Ray et al. | 164/529 |
| 6,759,134 | B1 | 7/2004 | Rosenberg | |
| 6,776,214 | B2 | 8/2004 | Ray et al. | |
| 6,786,984 | B1 | 9/2004 | Hanada et al. | |
| 6,799,626 | B2 | 10/2004 | Ray et al. | |
| 6,799,627 | B2 | 10/2004 | Ray et al. | |
| 6,846,369 | B1 | 1/2005 | Clark et al. | |
| 6,848,497 | B2 | 2/2005 | Sale et al. | |
| 6,986,381 | B2 | 1/2006 | Ray et al. | |
| 7,025,109 | B1 | 4/2006 | Ward et al. | |
| 2004/0206473 | A1 | 10/2004 | Sale et al. | |
| 2005/0279481 | A1 * | 12/2005 | Renkel et al. | 164/114 |

FOREIGN PATENT DOCUMENTS

| | | |
|---|---|---|
| EP | 0 820 737 | 1/1998 |
| GB | 1 577 974 | 10/1980 |
| JP | 59-179257 | * 10/1984 |
| JP | 05 088624 | 12/1993 |
| JP | 06 098903 | 4/1994 |
| WO | WO 97/16137 | 5/1997 |
| WO | WO 2004/040036 | 5/2004 |
| WO | WO 2004/040037 | 5/2004 |
| WO | WO 2005/053764 | 6/2005 |

OTHER PUBLICATIONS

Michael Black's Casting Manual, "The Basics of Paleoanthropological Casting," ch.3.

Hendricks, M., "Binder Additive Research Results: A New Drying Agent is Claimed to Eliminate Drying Related Defects Without Compromising Slurry Life," Foundry Trade J. (Mar. 2002).

"Investment Casting," efunda engineering fundamentals, www.efunda.com.

Cai et al., "In Vitro Corrosion Resistance of Titanium Made Using Different fabrication Methods," Biomaterials, Elsevier Science Publishers, 20(2):183-190 (Jan. 1999).

EP Search Report, from corresponding EP Appl. No. 07253851.5, dated Mar. 3, 2008.

EP Communication, from corresponding EP Appl. No. 07253851.5, dated Nov. 6, 2008.

* cited by examiner

CAST PARTS WITH IMPROVED SURFACE PROPERTIES AND METHODS FOR THEIR PRODUCTION

CROSS-REFERENCE TO RELATED APPLICATIONS

This application is a continuation application of a U.S. patent application bearing Ser. No. 11/536,149, filed on Sep. 28, 2006, entitled "Cast Parts With Improved Surface Properties and Methods for Their Production," the entirety of which is hereby incorporated by reference herein.

FIELD OF THE INVENTION

The present invention relates to cast parts, and more specifically techniques for producing such parts to provide improved cast surface properties when the cast material has high reactivity near its melting point.

BACKGROUND OF THE INVENTION

Metallic medical device parts that are suitable for surgical use and/or implantation in a patient can be difficult to create. Typically, the parts are formed using machining techniques that physically shape and finish the part surfaces. However, when parts reach a small enough scale (e.g., having a major axis below about 0.3 inches and/or a minor axis below about 0.08 inches), the cost of meeting the tolerances required to form such parts with conventional machining can become prohibitively expensive.

Casting provides a potential cost effective, alternative technique for forming such small-scale parts. The casting of medical-grade metals in a molten state for forming such parts, however, presents a number of challenges. In general, metallic materials that are suitable for medical applications are difficult to cast into small-scale pieces owing to their high chemical reactivity at temperatures close to the material's high melting point or range. In particular, as these molten metals are heated higher and higher above their melting point or range, they tend to become more and more reactive (e.g., undergoing oxidation reactions or other unwanted reactions with the mold surface). Such reactions lead to the formation of impurities that contaminate the metal parts, which result in various detrimental consequences. The presence of impurities skews the composition of the metal such that it may not meet the desired standard of a medical-grade material, thereby disallowing the use of the cast piece for the intended application. As well, the presence of the impurities can detrimentally affect the mechanical properties of the metallic material (e.g., lowering the strength of the material). Furthermore, such reactions can lead to surface texturing, which results in substantial, undesirable roughness on the surface of the cast piece. For example, using the surface roughness value Ra, as known in the art for characterizing surface roughness, cast pieces utilizing stainless steel alloys and/or titanium alloys are typically exhibit an Ra value between about 100 and 200 under good working conditions. Indeed, the production of small-scale cast pieces with such materials can be very difficult since the scale of the roughness features approaches the scale of the individual piece. These detrimental effects drive one to use lower temperatures for filling molds. If the temperature of the molten metal is not heated enough, however, the casting material can cool too quickly, leading to incomplete filling of the cast mold.

Accordingly, a need exists for improved techniques of casting small-scale metal pieces such that appropriately sized medical parts can be cast for use in surgical and implantation applications.

SUMMARY OF THE INVENTION

One exemplary embodiment is directed to a cast medical component. The component includes a cast metal part adapted for use with a medical device. Such cast metal parts can be suitable for exposure to an internal region of a patient's body. The part can be formed from a stainless steel alloy (e.g., precipitation hardened SS17-4 alloy) and/or a titanium alloy (e.g., $\alpha\beta$ Ti6Al4V alloy). The part can have an as cast surface with a roughness characterized by a Ra value lower than about 100, or lower than about 50. The part can have a major axis length less than about 0.3 inches, and/or a minor axis length less than about 0.08 inches.

Another exemplary embodiment is directed to a method of forming a cast portion of a medical device. Molten metal can be injected into a fluid-entry end of a sprue of a casting mold; techniques such as centrifugation can be utilized to perform the injection. The molten metal can include at least one of stainless steel and a titanium alloy. The sprue can be in fluid communication with one or more side runners. One or more of the side runners have a major axis that is optionally angled closer to the fluid-entry end of the sprue than the closed end (e.g., the major axis of the sprue and the side runner forming about a 45 degree angle). Additionally, or alternatively, the connection between the sprue and the closed-end side runner can be located a distance of at least about two sprue cross-sectional lengths from the closed end of the sprue, the closed-end side runner being the side runner located closest to the closed end of the sprue. At least a portion of the molten metal can impact the closed end of the sprue. One or more side runners can be backfilled with the molten metal to form corresponding cast objects.

In another embodiment, a flask for holding a casting mold can be kept at a temperature above about 870° C. before molten metal is injected into the casting mold. For example, the flask can be kept in a temperature range between about 870° C. and about 1000° C., or at a temperature of about 900° C. Casting molds can include materials such as aluminum oxide and/or silicon oxide.

Other embodiments are directed to using surfactants in the casting process. In one instance, a casting mold can be formed from mold-forming slurry comprising a surfactant having a volume percentage of surfactant solution in a range from about 0.9% to about 4.5% per volume of water present in the mold-forming slurry. The mold-forming slurry can be formed from a powder and water mixture with about 26 parts to about 30 parts of water for every 100 parts of powder. The mold-forming slurry can include at least one of aluminum oxide, and silicon oxide. In another instance, the surface of a casting tree can be contacted with a surfactant to wet the tree surface. The surfactant can be present in an aqueous solution, or can be water. A casting mold can subsequently be formed using mold-forming slurry by contacting the slurry with the wetted tree surface to improve the surface finish of the casting mold product pattern surface relative to not wetting the tree surface.

BRIEF DESCRIPTION OF THE DRAWINGS

The invention will be more fully understood from the following detailed description taken in conjunction with the accompanying drawings (not necessarily to scale), in which.

DETAILED DESCRIPTION OF THE INVENTION

Figure 1A:
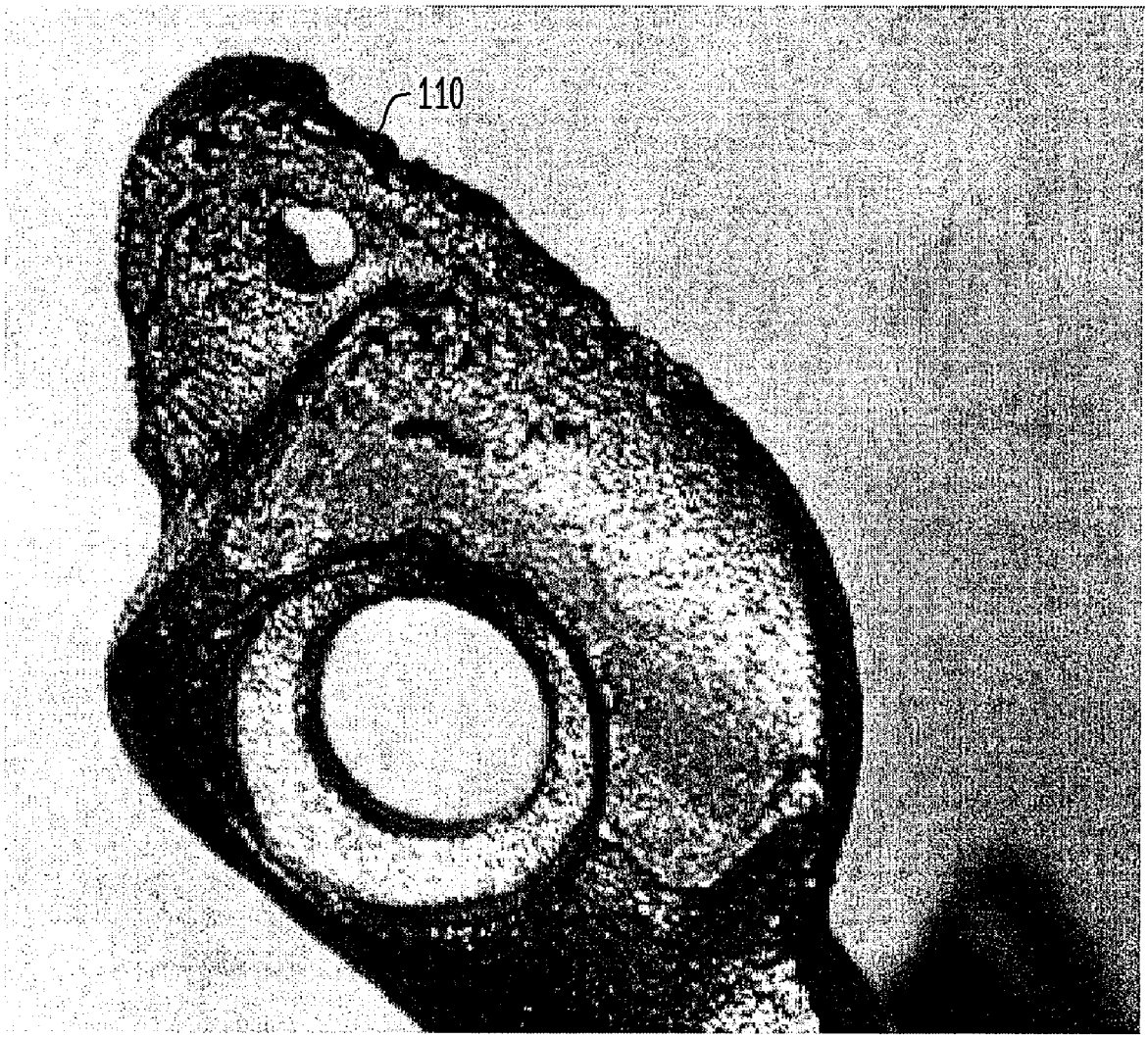
FIG. 1A (PRIOR ART)
FIG. 1A is a print of a cast joint having a rough surface formed using conventional casting methods.

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Some embodiments of the invention are drawn to cast medical components or devices. The cast pieces can be suitable for exposure to an internal region of a patient (i.e., the material is inert and will not leach harmful materials into a patient). In some embodiments, the components or devices can be cast from a metallic material such as a stainless steel alloy (e.g., precipitation hardened SS17-4 alloy) or a titanium alloy (e.g., αβ Ti6Al4V alloy). Particular embodiments can utilize a metallic material that can exhibit a narrow temperature working range, i.e., a small temperature range above the material's melting point or range before the melt becomes unacceptably reactive, which can lead to impurity contamination of the cast piece, i.e., resulting in the material no longer qualifying as medical-grade, and/or a loss of mechanical or surface properties, and/or incomplete part formation in the mold. As well, the metallic material can exhibit limited fluidity (e.g., high viscosity) even within an appropriate temperature working range. Of course, other types of materials for casting pieces can also be utilized with various aspects of the present application (e.g., non-metals that exhibit similar problems of viscosity and high reactivity near the material's melting point) despite specific references to particular casting materials such as metals and alloys.

Some embodiments are directed to cast components and devices that are generally small-scale. The size of such components can be described with respect to the length of a major axis and/or a minor axis. The major axis can be the longest length dimension of the cast piece, and the minor axis can be the shortest distance orthogonal to the major axis capable of defining a rectangle with the major axis that surrounds the cast piece in the plane formed by such axes. For example, the cast piece can have a major axis length less than about an inch or less than about 0.3 inches, and/or a minor axis length less than about ⅜ of an inch or less than about 0.08 inches. The terms "major axis" and "minor axis" can also be used to define the size of other structures, such as a sprue or a side runner of a cavity within a mold to form a cast tree as discussed herein. Some embodiments also allow a cast part to be formed with a surface roughness characterized by a Ra value below about 100 (i.e., below the ratings of the casting material as commercially recognized), or below about 50.

Figure 1B:
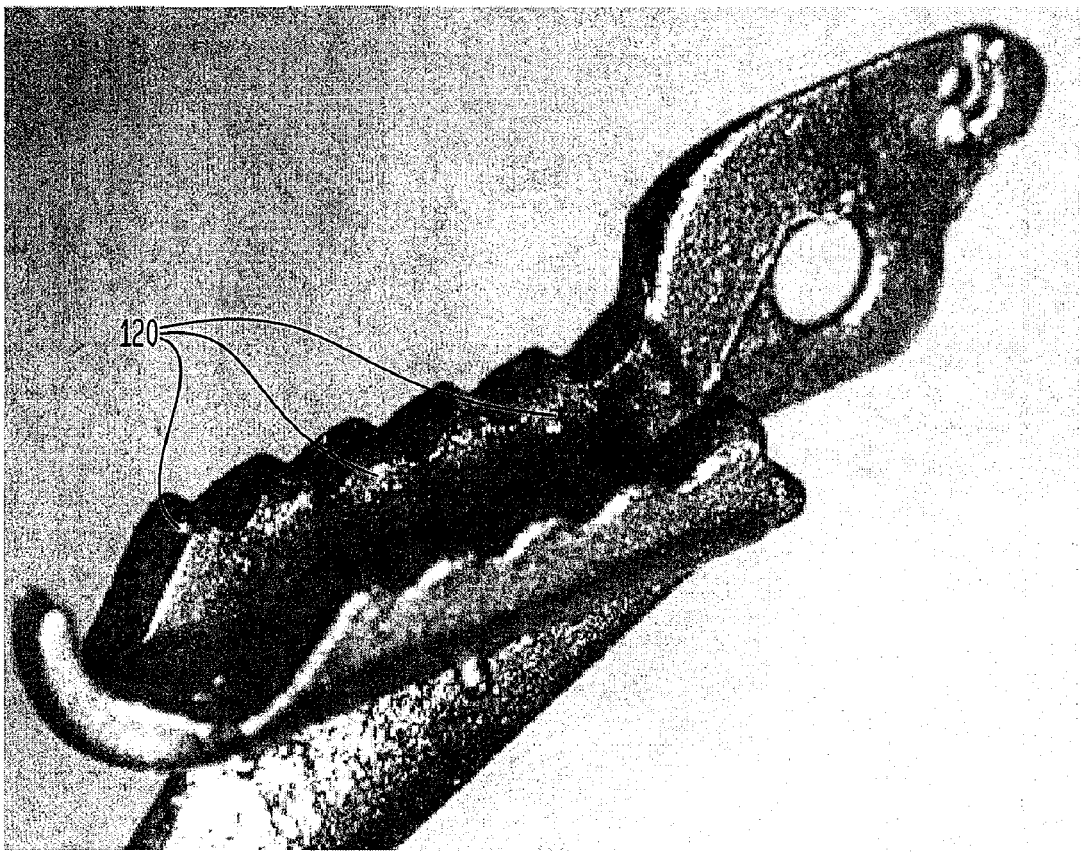
FIG. 1B (PRIOR ART)
FIG. 1B is a print of a cast jaw with bubbles formed on the surface thereof, formed using conventional casting methods.

Without being limited by any particular theory, it is believed that the techniques discussed herein can allow the creation of cast parts and devices, using medical-grade alloys such as stainless steel alloys (e.g., precipitation hardening SS17-4) and titanium alloys (e.g., α-β Ti6Al4V), with the size and/or roughness characteristics discussed herein because such techniques can at least in part alleviate particular problems associated with conventional casting that yield products that are too rough, or have roughness characteristics that are comparable to the size of the part (i.e., yielding an inoperable part), or are incapable of reliably forming a completely cast piece. For example, as shown in FIG. 1A, a joint formed using conventional casting of a metallic alloy shows substantial roughness 110. FIG. 1B depicts bubbles 120 formed on the jaw piece due to bubble formation in the mold.

Figure 2:
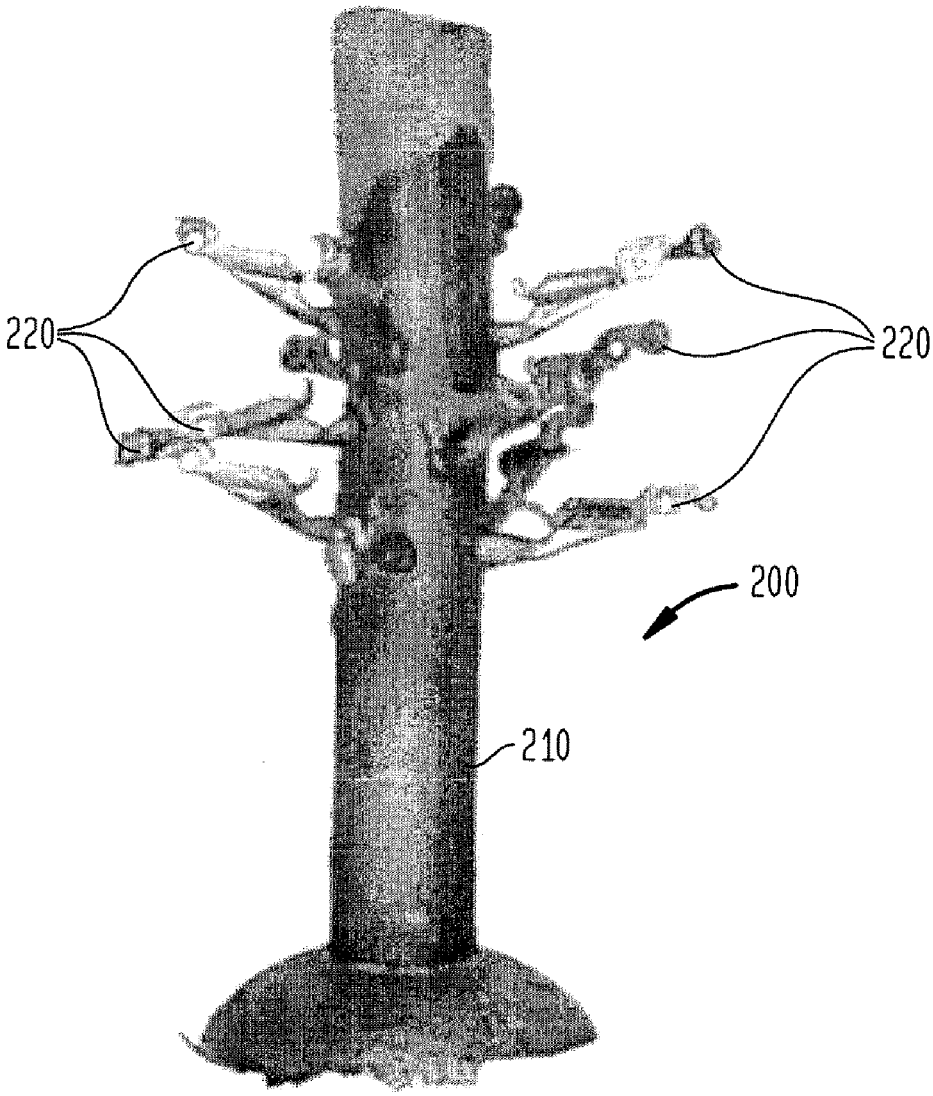
FIG. 2 presents a perspective view depicting a cast tree having a sprue and product side branches, consistent with an embodiment of the invention.

Cast pieces and devices consistent with exemplary embodiments described herein can be formed in conjunction with a cast tree. FIG. 2 depicts a cast tree 200 consistent with some exemplary embodiments. The tree 200 can be formed by flowing molten casting material through a sprue to form a corresponding trunk structure 210. The sprue can be in fluid communication with one or more side runners. Each side runner can correspond to a product branch arm 220 that includes a desired cast piece, exemplified as a portion of a foreceps jaw as shown in FIG. 2. Upon formation and hardening of the entire tree 200, each branch arm 220 can be detached from the trunk structure 210 and subsequently utilized as at least a portion of a corresponding medical device. Trees consistent with exemplary embodiments can have trunk structures and branch arms of varying sizes and shapes. For example, branch arms need not all be the same size or oriented is a symmetric pattern. As well, the number of branch arms and their relative orientation with respect to the trunk structure can vary, including in ways beyond those explicitly mentioned within the present application.

Trees such as those depicted in FIG. 2 can be formed using an investment casting process. The steps of an exemplary investment casting process 300 are described with reference to the flowchart of FIG. 3. A tree pattern is formed to act as a cavity-shaping object in a step 310 of the process 300. The tree pattern can be constructed with polymeric materials such as wax and/or plastics (e.g., polystyrene arms), and/or other materials capable of being removed during a "burn out" step. The one or more side runners of the tree pattern can each act to form a fluid path to the cavity that corresponds to a cast part upon completion of the process. The tree pattern can be inserted into a flask 320 that acts to hold investment slurry that will form a mold. The types of investment slurries that can be utilized include those that are appropriate for casting a chosen molten material. Examples include aluminum oxide based slurries, and silicon and oxygen based slurries, (e.g., J Formula Platinum Investment, Romanoff International, Amityville, N.Y.; 780 Investment, Dentsply International—Ransom & Randolph, Maumee, Ohio). Investment slurry is added to the flask 330, which contains the tree pattern, and can be placed subsequently in a vacuum chamber to remove air bubbles. Upon hardening of the investment slurry, the flask and mold can be placed in an oven to burn out the tree pattern components 340 (e.g., sprue-forming wax trunk, plastic arms, and/or other portions of a plastic pattern) to leave a cavity within the hardened investment mold for inserting cast material. Next, the mold can be filled with molten casting material (e.g., molten metal 350) by some filling mechanism such as a commercially-available centrifuge having a vacuum gas chamber. The flask and mold can be positioned within the centrifuge, with a solid metallic cast material placed in a crucible for subsequent melting and injection. Upon closing the centrifuge lid, the chamber can be evacuated and back filled with a non-reactive gas (e.g., argon), while the metallic cast material can be exposed to an appropriate temperature (e.g., by heating with electrical induction) to become molten. Acceleration of the centrifuge will allow molten metal to be inserted into the investment mold. Such injection can occur at a rapid rate to promote filling of the mold cavity before the molten material begins to solidify. After the molten metal cools and solidifies, the mold can be removed 360 to reveal a metallic cast tree. The components can be removed 370 from the branch arms of the cast tree, for example by degating, and subsequently used as a part of a medical device.

Though cast trees can be formed using investment casting as previously described, any number of known casting techniques can also be used. Those skilled in the art will readily appreciate that the techniques discussed herein can be applied to other known casting methods, in any combination, to form parts and other products as discussed herein.

The following embodiments describe techniques that can be employed in casting (e.g., investment casting) to improve the surface qualities, and/or the yield, of cast metallic pieces, as described herein. Though each embodiment can be practiced as a separate technique, one or more of the techniques can be combined to form other embodiments. It is understood that any of the techniques can be practiced alone or combined with any other(s), and all such permutations are within the scope of the present application.

Backfilling of Side Runners

One exemplary embodiment is directed to forming a cast portion of a medical device. Molten metal can be injected into a fluid-entry end of a sprue in a mold, such as by use of a centrifuge. The types of molten metal include all those previously discussed herein such as stainless steel alloys or titanium alloys. The sprue can have one or more side runners in fluid communication therewith. The molten metal can quickly traverse to a closed end of the sprue (e.g., before the molten metal can completely fill a side runner), impacting against the closed end and reversing flow direction. The molten metal can subsequently backfill one or more of the side runners. Such backfilling can result in the complete filling of a side runner, thereby forming a cast object upon cooling of the metal.

Figure 4A:
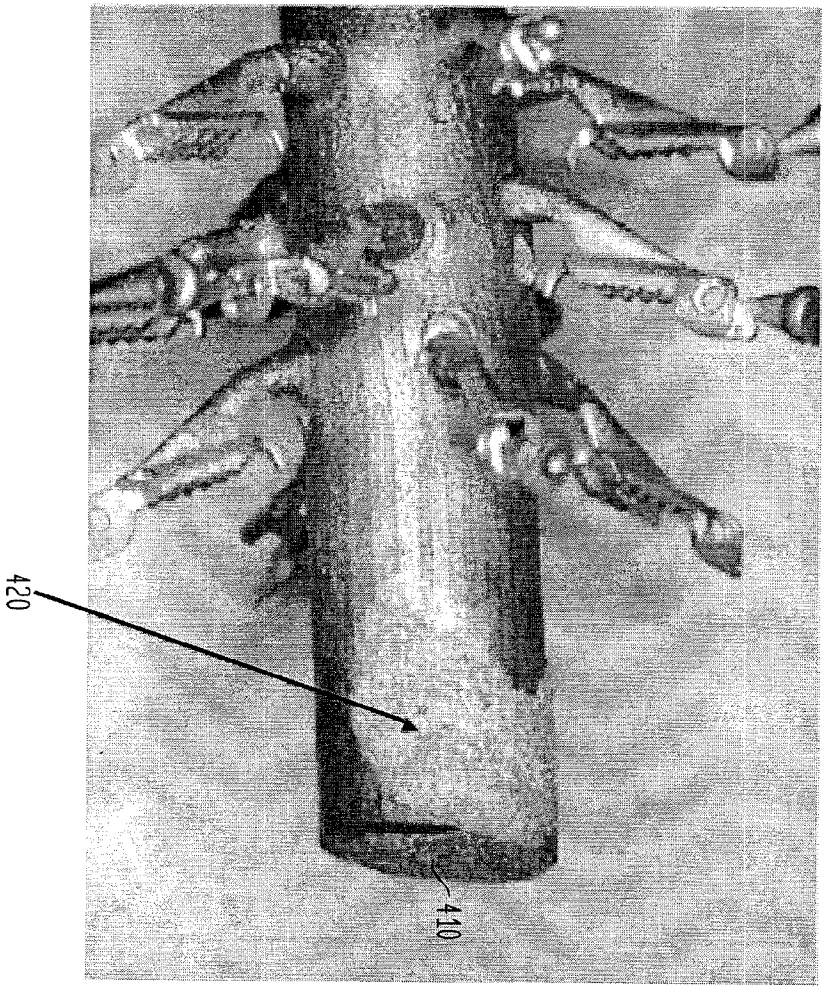
FIG. 4A is a print of the closed end of a cast tree showing surface roughness from casting slurry reactions with the investment, consistent with an exemplary embodiment.
Figure 4B:
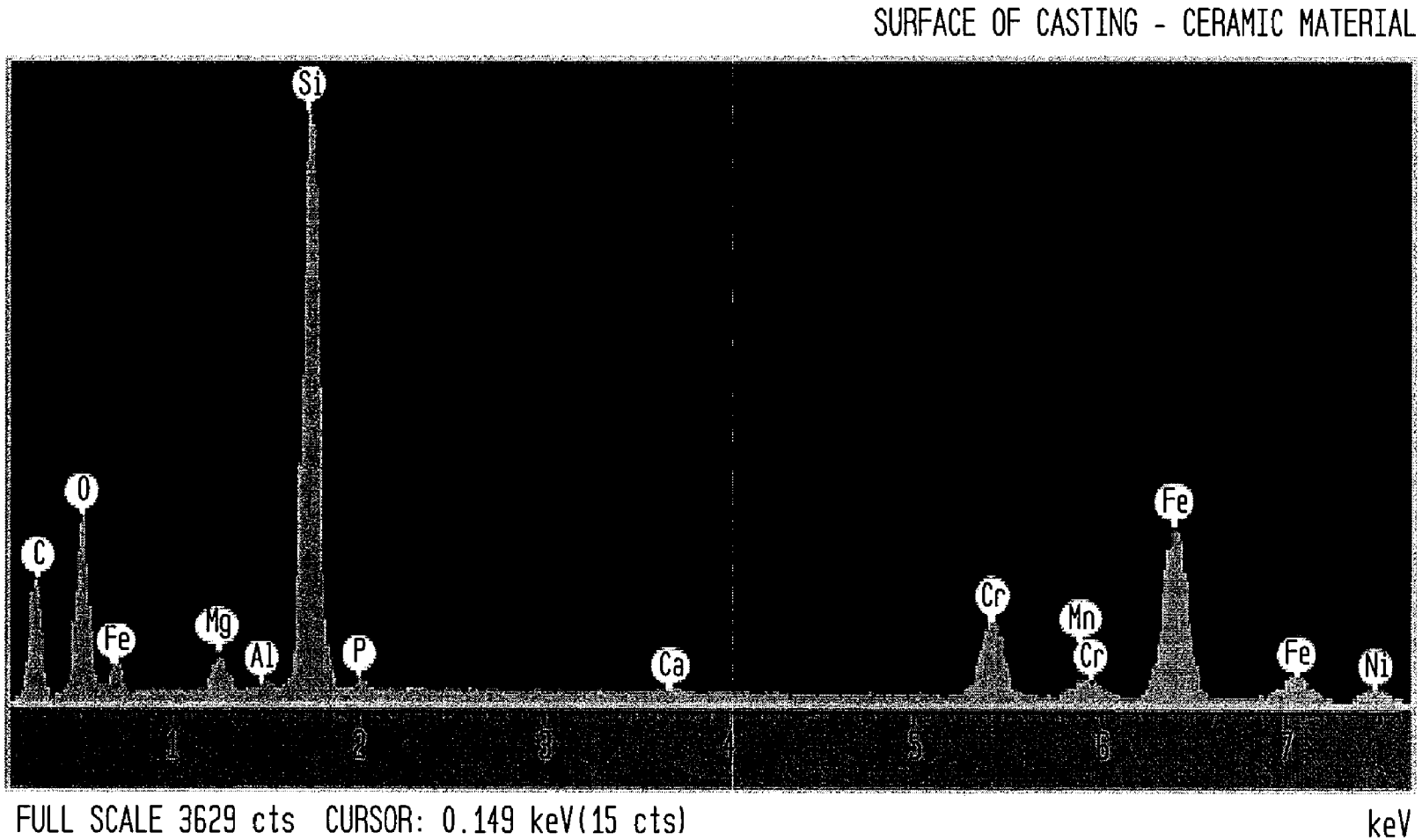
FIG. 4B is a graph from scanning electron microscopy and x-ray analysis of the rough surface of the closed end of the sprue shown in FIG. 4A, indicating the high silicon content near the surface.

Such an embodiment can be advantageous since the molten metal can be heated substantially above its melting point, to allow the molten metal to adequately fill the cast mold side runners. Without necessarily being bound by any particular theory, though the molten material can undergo some oxidation or other surface reactions with the mold surface due to its high temperature, the impacting against the closed sprue end can result in precipitation of impurities in the extraneous trunk structure. As shown in FIG. 4A, the closed end 410 of a sprue of a tree formed from stainless steel SS17-4 shows a roughened surface 420. Scanning electron microscopy and x-ray (SEM/EDX) analysis of the roughened surface, as depicted by the graph of FIG. 4B, shows a substantial amount of silicon and oxygen components on the surface, which can be presumed to correspond with surface reaction on the mold. Accordingly, a reaction occurs at the closed end of the sprue. After impacting, the molten metal can cool to a lower temperature, though still high enough to maintain adequate viscosity to allow backfilling of the side runners. Injection of the molten material at a lower temperature may hinder the tendency to form impurities, but subsequent cooling as the molten metal fills the mold cavity can result in solidification before the molten metal fills the interstices of the mold completely.

Figure 5A:
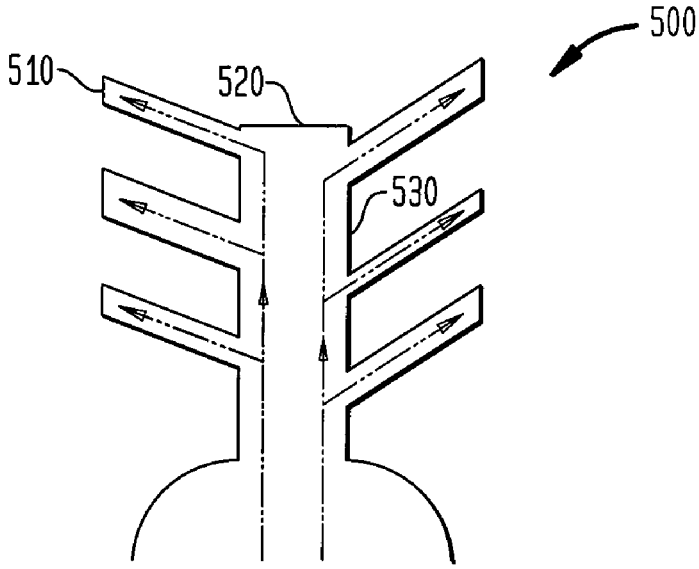
FIG. 5A presents a schematic side view depicting a tree pattern with side runners connected to the sprue at a position adjacent to the closed end of the sprue, flow pattern lines depict the entry of molten material into the side runners before molten material impacts the closed end of the sprue.
Figure 5B:
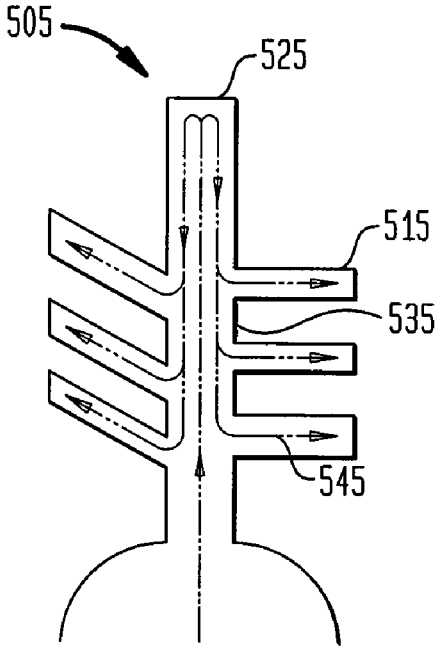
FIG. 5B presents a perspective view depicting a tree pattern with side runners connected to the tree pattern at a position farther from the closed end of the sprue compared to the tree pattern shown in FIG. 5A, flow pattern lines depict the back-filling of molten material into the side runners after the material impacts the closed end of the sprue.

In another exemplary embodiment, the tree pattern of a mold includes a sprue having a closed end and a fluid entry-end, the latter including an opening for inserting molten material. The sprue can be characterized by a cross-sectional length. The tree pattern can have one or more side runners that are in fluid communication that can be positioned such that closed-end side runner (i.e., the side runner located closest to the closed end of the sprue) connection to the sprue is at least two sprue cross-sectional lengths from the closed end of the sprue (e.g., the distance from the closed end of the sprue to the beginning of the connection between the sprue and the side runner is at least about two sprue cross-sectional lengths). FIG. 5A depicts the tree pattern 500 of a mold with closed-end side branches 510 that are closely located to the closed end 520 of the sprue 530. Comparatively, as depicted in FIG. 5B, the side runners 515 of tree pattern 505 can be positioned away from the closed end 525 of the sprue 535, which can promote reaction of impurities and cooling of molten metal before backfilling into the side runners as depicted by flow lines 545. In an alternative embodiment, the closed-end side runner connection to the sprue is positioned at least three sprue cross-sectional lengths from the closed end of the sprue. Since an excessively long sprue can result in molten metal cooling that hinders runner filling, other embodiments are directed to the length between the closed-end side runner connection and the closed end of the sprue being between about two to about four, or between about two to about three, sprue cross-sectional lengths.

Potential cross-sectional lengths include a diameter of the sprue when the sprue has a substantially uniform circular cross-section. For non-circular cross-sections, the cross-sectional length can correspond to an effective diameter that yields the appropriate cross-sectional area of the sprue using the standard circle formula. If the cross-sectional area is non uniform, an average or median cross-sectional area along a chosen sprue length can be utilized to calculate the effective diameter, and thus the cross-sectional length. Other potential measures of cross-sectional length include the square-root of the average or median cross-sectional area along a given length portion of the sprue.

Figure 6A:
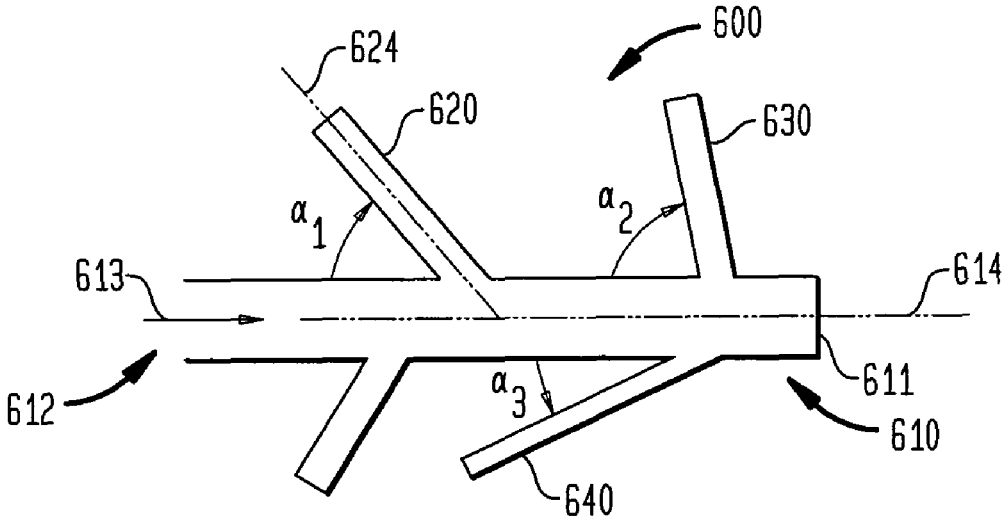
FIG. 6A is a schematic cross-sectional diagram of a tree pattern with side runners angled closer to the fluid-entry end of the sprue than the closed end.

In another embodiment, the tree pattern of a mold can be oriented with one or more side runners positioned to promote backfilling of the side runners after molten metal impacts the closed end of the sprue. For example, one or more side runners can be positioned such that their major axis is angled closer to the fluid-entry end of a sprue than the closed end of the sprue. As depicted in FIG. 6A, the sprue 610 of tree 600 has a major axis 614 along which molten material can be injected in a direction 613. The side runner 620 has a major axis 624 angled closer to the fluid-entry end 612 of the sprue 610 than the closed end 611 (i.e., the major axes 614 and 624 form an acute angle $\alpha_1$). Other side runners 620, 630 are oriented to form angles $\alpha_2$ and $\alpha_3$, which are each angled closer to the fluid-entry end 612 than the closed end 611 of the sprue 610. In one particular embodiment, one or more of the side runners have a major axis that forms about a 45 degree angle when intersecting the major axis 611 of a sprue on a side of the side runner closer to the fluid-entry end of the sprue.

Figure 6B:
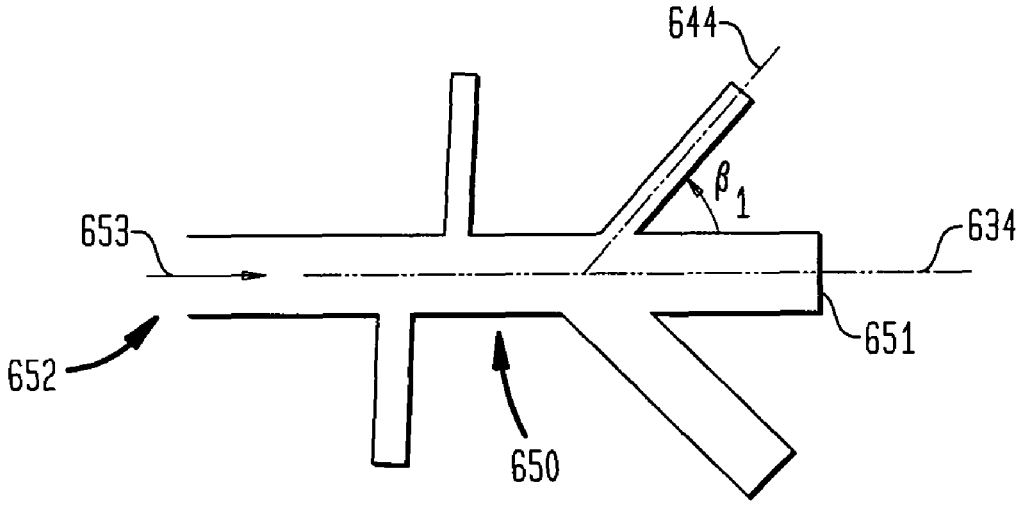
FIG. 6B is a schematic cross-sectional diagram of a tree pattern with side runners either orthogonal to the major axis of the sprue, or angled closer to the closed end of the sprue than the fluid-entry end.

Without necessarily being bound by any particular theory, it is believed that an orientation of side runners relative to sprue flow direction can promote backfilling of side runners after the molten metal impacts the closed end of the sprue. For example, the tree configuration shown in FIG. 6B represents the conventional approach in which the side runners are angled toward the closed end of the sprue. However, since the side runner 644 is angled closer to the closed end 651 of the sprue 650 than the fluid-entry end 652, molten metal flowing down the sprue 650 in the direction 653 will have a tendency to fill the side runners more readily before impacting the closed end 651 relative to the tree configuration of FIG. 6A. As a result, detrimental reactivity of the molten metal can more readily occur in a side runner, potentially entraining the cast product material with impurities. In contrast, the angled side runners of the tree in FIG. 6A promote filling of the side runners in the backfilling direction (i.e., opposite the flow direction given by the arrow 613). As such, impurity formation in the side runners is hindered, for example by promoting any such impurity formation toward the closed end segment of the sprue.

In a particular embodiment, the features of utilizing an extended sprue length toward the closed-end and orienting side runners away from the closed end of the sprue can both be employed during casting, for example during centrifugal investment casting. Centrifugal investment casting employs pressure created by centrifugal force to drive flow. Consistent with the present embodiment, the centrifugal force is working in two dimensions: first to eject the molten metal out of the melting crucible and into the sprue, and then second from the sprue into the runners and part cavities, i.e., driving backfilling. Combining the features of a longer sprue and a reversed direction of the runner system, relative to what is utilized in a conventional gravity feed runner system, can help achieve complete filling of the cavities before solidification.

Temperature Elevation

Another exemplary embodiment is directed to subjecting a mold to a temperature above some designated temperature to help reduce defects in casted pieces. For instance, flasks that are used in investment casting to form molds can be kept at a temperature above about 780° C., or above about 870° C., to elevate the temperature of the mold material during molten metal insertion (e.g., by pouring or injection). The temperature can be kept within a particular temperature range (e.g., between about 780° C. and about 1000° C., or between about 870° C. and about 1000° C., or between about 870° C. and about 950° C.), or around a particular temperature (e.g., about 900° C.). In one embodiment, the mold is subjected to a temperature or temperature range above the temperature range that is conventionally utilized during investment casting but below the temperature at which the mold will degrade or promote undesirable chemical reactions within the mold during molten metal insertion. Mold materials that are based on aluminum oxide and silicon oxide can potentially benefit from the technique. Such a temperature or temperature range can be achieved, in one exemplary instance, in conjunction with a pattern burnout step in a furnace. The furnace can be run in one continuous cycle for about 12 hours to achieve burnout and the appropriate flask temperature. Subsequently, molten metal can be added (e.g., poured into) to the mold immediately following completion of the burnout step. In some instances such as conventional gravity feeding, a tube for feeding molten metal into the mold can also be kept at the specified temperature or temperature range to hinder excessive cooling of the molten metal as it enters the mold. When centrifugal casting is employed, a tube or conveying device is not required. The metal can be melted in a crucible that has a hole or spout up near the crucible's top edge, and positioned very close to the sprue opening of the mold. The crucible can be positioned at a slight angle such that under centrifugal force the liquid metal flows up the inclined side of the crucible and out the spout, traversing the short free space distance between the crucible spout and the mold, and then flowing directly into the sprue opening in the mold which is aligned directly with the crucible spout.

Experiments conducted using increased flask temperature resulted in nearly an order of magnitude less incomplete side runner fills relative to using a temperature below 780° C. The elevated temperature also tended to improve the finish of completed cast pieces (i.e., resulting in the presence of fewer voids, gas bubbles, and ceramic impurities on the surface of cast pieces). It is believed that elevated flask temperatures can help maintain particular molten metal alloys above their melt temperature to allow the molten material to completely fill the part cavities before cooling and solidifying while completely contained within the cavity of the mold. In addition, it can be advantageous to design a feeding runner and dump or molten material reservoir not to chill before the cavity of the mold is completely filled and begins chilling within the cavity of the mold.

Surfactant Usage

Another technique consistent with exemplary embodiments utilizes surfactants to reduce the tendency for bubble formation in molds, which can detrimentally impact the surface quality of cast parts. In one embodiment, surfactant can be added to a mold slurry to help improve the surface finish of the mold cavity upon solidification. For example, the surfactant can be added into the mold slurry and subsequently inserted into a flask having a tree pattern to form the desired mold pattern. The surfactant can be disposed as an aqueous detergent solution (e.g., a commercial liquid detergent such as Dawn Liquid Dishwashing Detergent, distributed by Procter & Gamble, dispersed in water). Though a variety of concentrations of liquid detergent can be utilized in a mold slurry, in one particular embodiment the surfactant is distributed as a liquid detergent solution having a concentration above about 0.9%, or above about 1.8%, by volume per volume of water present in the mold slurry. In general, higher concentrations of surfactant can also be utilized. In some instances, the liquid detergent concentrations can become too high as to cause accelerated investment setting. Accordingly, in some embodiments, the liquid detergent can have a concentration below about 4.5%, or below about 3.6%, or below about 2.7%, by volume per volume of water present in the mold slurry. As well, the liquid detergent concentration can be between about 0.9% to about 4.5%, or between about 0.9% to about 3.6%, or between about 1.8% to about 2.7%, by volume per volume of water present in the mold slurry. Such ranges can have the advantages of utilizing sufficient surfactant to reduce bubble formation, while preventing the use of excessive surfactant that can potentially decrease the working time of the mold slurry by accelerated catalysis of mold slurry setting. The concentration of the remaining components of the mold slurry can depend upon the type of mold material utilized. For example, a silicon and oxygen based investment slurry (e.g., 780 Investment, Dentsply International—Ransom & Randolph, Maumee, Ohio) can utilize a range from about 26 to about 30 parts of water to 100 parts of dry investment powder by weight. Of course, other mold materials can also be used such as aluminum oxide.

Experiments conducted comparing bubble defect formation in molds that do not include the use of surfactant, compared with molds that use surfactant, show a decrease in bubble defects from 33% to about 3%. In general, the number of bubble defects tends to decrease as the amount of surfactant in the mold increases.

In another embodiment, surfactant can be applied onto a pattern, such as a tree pattern, which subsequently forms the cavity within a mold. For example, the pattern can be part of an investment casting process in which the surfactant-applied pattern is placed in a flask, followed by mold slurry to shape the slurry to form a desired cavity within a solidified mold. The surfactant can be present in an aqueous solution (e.g., a detergent dispersed in water). As well, the aqueous solution can be water. As used herein, the term "water" includes the various grades of water that are typically utilized within the scope of commercial and laboratory applications (e.g., distilled water, filtered water, water passed over commercial activated charcoal systems, various grades of deionized water, typical drinking water, etc.). This embodiment can also be practiced along with all the variations of adding surfactant to the mold slurry as described herein.

Experiments conducted by applying an aqueous detergent solution to a wax tree during investment casting of a molten metal alloy resulted in a cast part with improved surface finish. In comparing experiments where water is used as a surfactant against the use of no surfactant on pattern trees, the wetted pattern trees resulted in nearly three times higher yield of having a cast part with conforming surface finish with regard to the channel feature.

EXPERIMENTS

The following experimental results are provided to illustrate some aspects of the present application. The experiments, however, are not intended to limit the scope of any embodiment of the invention.

Figure 3:
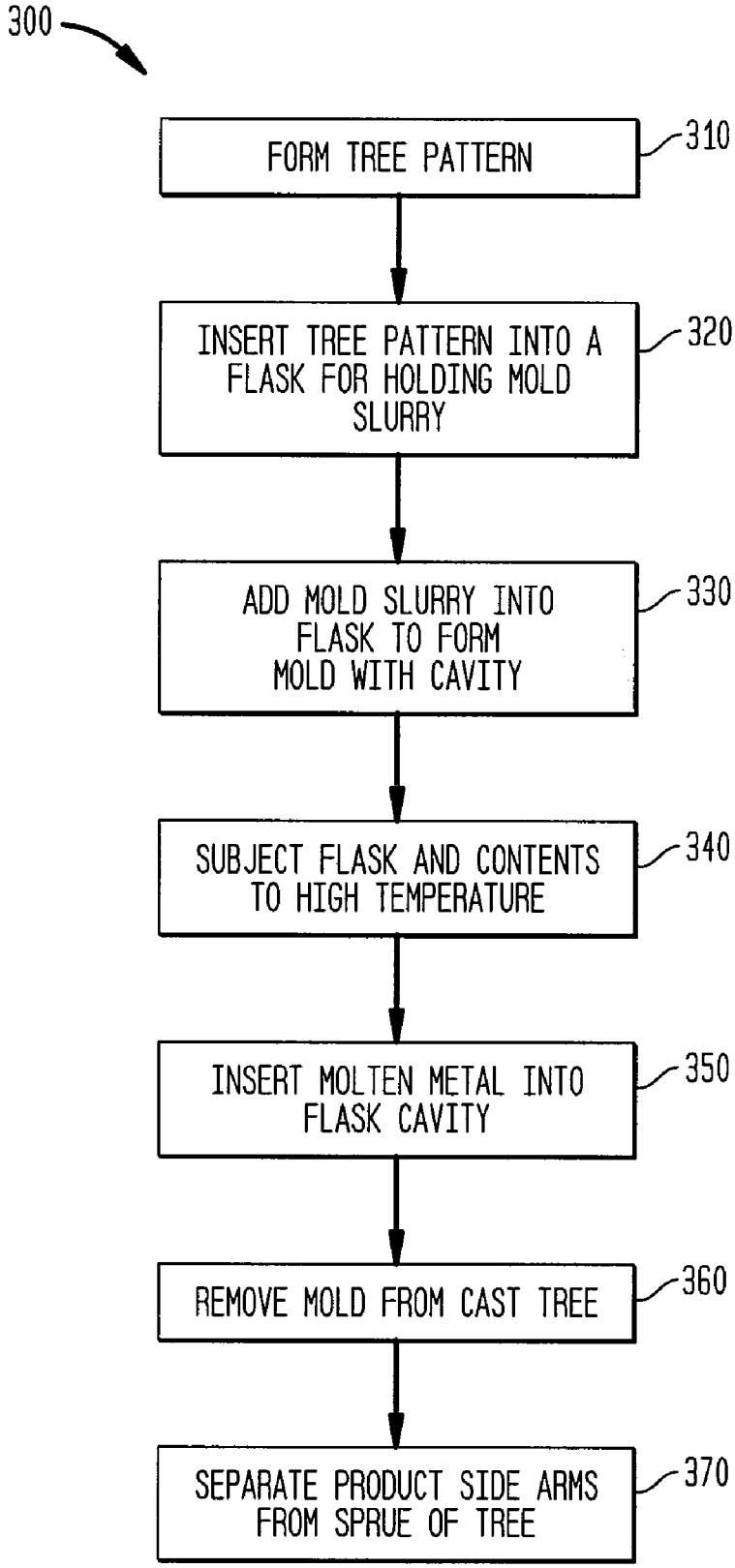
FIG. 3 presents a flow chart of the steps of an exemplary investment casting process, consistent with some embodiments of the invention.

In general, the experiments described below utilize investment casting operations that follow the process described in the flowchart of FIG. 3 using a centrifuge, and employ the particular modifications described herein. Unless otherwise stated, the molten metal utilized in all experiments was a precipitation-hardened 17-4 stainless steel. As well, the investment material was 780 Investment from Dentsply International—Ransom & Randolph, Maumee, Ohio.

Experiment 1

Effect of Length Toward the Closed End of the Sprue

A total of 16 product trees, each tree having 12 product side runner arms, were cast under a variety of conditions as documented in Table 1 below. The sprue diameter was approximately 25/64 of an inch.

TABLE 1

Experimental Conditions of Experiment 1

| Run # | Flask Height (in.) | Flask Temp (° C.) | Spin Time (sec) | Cast Temp (° C.) | Surface Reaction Grade |
|---|---|---|---|---|---|
| 1 | 2.5 | 760 | 30 | MP | 1 |
| 2 | 2.5 | 760 | 3 | MP | 1 |
| 3 | 2.5 | 760 | 30 | MP + 50 | 3 |
| 4 | 2.5 | 760 | 3 | MP + 50 | 2 |
| 5 | 3.5 | 760 | 30 | MP | 3 |
| 6 | 3.5 | 760 | 3 | MP + 50 | 2 |
| 7 | 3.5 | 760 | 30 | MP + 50 | 2 |
| 8 | 3.5 | 760 | 3 | MP | 2 |
| 9 | 2.5 | 870 | 3 | MP + 50 | 2 |
| 10 | 3.5 | 870 | 30 | MP + 50 | 2 |
| 11 | 2.5 | 870 | 30 | MP + 50 | 2 |
| 12 | 2.5 | 870 | 30 | MP | 1 |
| 13 | 3.5 | 870 | 3 | MP + 50 | 3 |
| 14 | 3.5 | 870 | 3 | MP | 3 |
| 15 | 3.5 | 870 | 30 | MP | 3 |
| 16 | 2.5 | 870 | 3 | MP | 2 |

A flask height of 2.5 inches corresponded with having the side runner closest to the closed end of the sprue being positioned substantially adjacent to the closed-end of the sprue. A flask height of 3.5 inches corresponded with having the side runner closest to the closed end of the sprue being positioned about one inch from the closed-end of the sprue, i.e., the closed-end side runner connection is approximately 2.56 sprue diameters from the closed end of the sprue. Flask temperature refers to the temperature of the flask and mold assembly during injection of the molten metal. Spin time refers to the amount of time the centrifuge operates to inject the molten metal. In terms of casting temperature, MP corresponds to about 1250° C., the temperature at which the metal completely liquefies; the material melts over a range of temperature.

The effect of flask height on the amount of surface reaction on the parts of a tree, i.e., the amount of surface reaction on side runners, was qualitatively graded on a 1 to 3 scale, 1 being the highest amount of surface reaction on parts and 3 being the lowest amount of surface reaction on the parts. Using such a scale, the surface reaction grade on parts is listed in the right-most column of Table 1 above. In terms of average values, a flask height of 2.5 corresponds with an average surface reaction grade of about 1.8, while a flask height of 3.5 corresponds with an average surface reaction grade of about 2.5. Accordingly, the experiment shows that the longer length of sprue after the closed-end side runner results in less side reaction on part formation in a tree.

Experiment 2

Effect of Side Runner Angular Orientation

A total of 4 product trees were created, each tree having 12 product side arm runners. Two of the product trees were cast with side arm runners angled toward the fluid-entry end of the sprue (e.g., as depicted in FIG. 6A), while the other two product trees were cast with side arm runners angled toward the closed-end end of the sprue (e.g., the closed-end runners shown in FIG. 6B). The product side arms were cast as jaw pieces of a medical device with a number of teeth. The surface roughness of the product side arms were measured on a qualitative scale of 1 or 2 to determine any potential effect due to side runner orientation.

By qualitative observation, it was quantified that the jaw pieces had no visible defects (grade 1) for the trees with side arms angled toward the fluid-entry end of the sprue. In contrast, the trees with product side arms angled toward the closed end of the sprue had a small amount of surface roughness and visible defects (grade 2).

Experiment 3

Effect of Flask Temperature on Cast Product

Eight product trees were cast, each tree having 12 product side arms. The trees were cast using 780 Investment from Dentsply International—Ransom & Randolph, Maumee, Ohio. Four of the product trees were cast using a flask temperature of 760° C. and the remaining four using a temperature of 900° C.; the latter exceeding the temperature that the manufacturer recommends the investment material be exposed. For each tree, the product side runners were examined for incomplete filling and surface roughness. In particular, surface roughness was qualitatively graded on a 1 to 5 scale, with 1 being minimal to no roughness and 5 being the maximum grade for roughness observed on cast parts.

Flask temperatures and observed data are presented in Table 2.

TABLE 2

Flask Temperatures and Results from Experiment 3

| Run# | Flask Temperature (° C.) | Number of Incomplete Fills | Surface Roughness Grade |
|---|---|---|---|
| 1 | 760 | 7 | 1 |
| 2 | 760 | 5 | 1 |
| 3 | 760 | 3 | 2 |
| 4 | 760 | 1 | 2 |
| 5 | 900 | 0 | 1 |
| 6 | 900 | 1 | 1 |
| 7 | 900 | 0 | 1 |
| 8 | 900 | 0 | 1 |

Using the values of Table 2, the average number of incomplete fills of side runners for trees subject to a flask temperature of 760° C. is 4, and the average surface roughness grade is 1.5. In contrast, for trees subject to a flask temperature of 900° C., the average number of incomplete fills is 0.25, and the average surface roughness grade is 1. Accordingly, on average, the higher flask temperature results in fewer incomplete fills of side runners and generally less surface roughness.

Experiment 4

Effect of Adding Surfactant to Investment on Product Surface Bubble Formation Sixteen product trees were cast, each tree having 12 product side runners. The trees were cast using 780 Investment from Dentsply International—Ransom & Randolph, Maumee, Ohio. The preparation of the investment material followed the manufacturer's instructions with the exception that 2 mLs of Simple Green Soap Cleaner (Sunshine Makers, Inc., Huntington Harbour, Calif.) replaced an equal volume of water for use in the molds of eight of the cast trees; the remaining eight trees followed the standard investment preparation. Upon completing casting of the trees, all product arms of each tree were examined for the presence of bubbles. The total number of bubbles associated with all product side runners for a particular cast tree were recorded.

A summary of the results for the sixteen cast trees is shown in Table 3.

TABLE 3

Results from Experiment 4

| Run# | Soap added to investment | # of bubbles on side runners |
|---|---|---|
| 1 | 2 ml | 0 |
| 2 | 2 ml | 0 |
| 3 | 2 ml | 0 |
| 4 | 2 ml | 0 |
| 5 | 2 ml | 0 |
| 6 | 2 ml | 0 |
| 7 | 2 ml | 2 |
| 8 | 2 ml | 1 |
| 9 | 0 ml | 3 |
| 10 | 0 ml | 1 |
| 11 | 0 ml | 3 |
| 12 | 0 ml | 8 |
| 13 | 0 ml | 9 |
| 14 | 0 ml | 9 |
| 15 | 0 ml | 3 |
| 16 | 0 ml | 2 |

The results of the experiment indicate that of the 96 parts formed, i.e., each part corresponding to one product side runner, 33.3% of the parts were defective due to bubble formation for trees formed without the use of surfactant in the investment material. In contrast, for trees formed using investment material entrained with 2 mLs of soap solution, only 3.1% of the parts were defective due to the presence of surface bubbles.

Experiment 5

Effect of Water on Part Surface Finish

Eight product trees were cast, each tree having twelve product side runners. The product side arms were cast as jaw pieces of a medical device with a number of teeth. The surface finish of the areas between the teeth were investigated to see if a smooth finish could be achieved by any of the side arms of the cast trees. In particular, for four of the trees, a drop of deionized water was placed between the rows of teeth of all 12 product side branches of a wax tree just before investment was added to the flask. For the remaining four trees, a drop of deionized water was placed between the rows of teeth of 6 of the 12 product side branches of the wax tree just before investment was added to the flask. The surface between the teeth of the final casted product tree was examined for the presence of surface reaction. The presence of surface reaction was qualitatively graded on a 0 to 5 scale, with 0 indicating minimal to no surface reaction and 5 corresponding with the maximum surface reaction grade.

The results of the experiments are shown in Table 4.

TABLE 4

Results from Experiment 5

| Run# | # of wetted side branches on wax tree | Surface Reaction Grade on Parts Corresponding to Dry Patterns | Surface Reaction Grade on Parts Corresponding to Wet Patterns |
|---|---|---|---|
| 1 | 12 | N/A | 1 (12 parts) |
| 2 | 6 | 3 (6 parts) | 1 (6 parts) |
| 3 | 12 | N/A | 2 (12 parts) |
| 4 | 6 | 3 (6 parts) | 1 (6 parts) |
| 5 | 12 | N/A | 1 (12 parts) |
| 6 | 6 | 4 (6 parts) | 2 (6 parts) |
| 7 | 12 | N/A | 1 (12 parts) |
| 8 | 6 | 3 (6 parts) | 1 (6 parts) |

As shown in Table 4, areas between part teeth that are dry generally have a higher surface roughness grade than areas that are wetted with deionized water. The average value of the surface roughness grade for wetted regions is 1.25, as compared with an average surface roughness grade of 3.25 for dry regions.

One skilled in the art will appreciate further features and advantages of the invention based on the above-described embodiments. Accordingly, the invention is not to be limited by what has been particularly shown and described, except as indicated by the appended claims. Indeed, as previously mentioned, one or more of the techniques can be practiced alone, or combined with any others to provide product cast pieces (e.g., combining angling of side runners with positioning the closed-end side runner at least two cross-sectional lengths from the closed end of a sprue). All publications and references cited herein are expressly incorporated herein by reference in their entirety.

What is claimed is:

1. A method of forming a cast portion of a medical device, comprising:

injecting molten metal into a fluid-entry end of a sprue of a casting mold using centrifugation, the molten metal being reactive during injection such that the molten metal can undergo reactions at a surface of the sprue, the sprue being in fluid communication with at least one side runner;

impacting at least a portion of the molten metal against a closed end of the sprue; and backfilling the at least one side runner with molten metal to form at least one cast object, the at least one cast object having a major axis length less than about one inch and the at least one side runner including a major axis angled closer to the fluid-entry end than the closed end.

2. The method of claim 1, wherein a connection between the sprue and a closed-end side runner is positioned a distance within a range of about two effective sprue diameters to about four effective sprue diameters from the closed end of the sprue, the closed-end side runner being a side runner located closest to the closed end of the sprue.

3. The method of claim 1, wherein the molten metal comprises at least one of a stainless steel and a titanium alloy.

4. The method of claim 3, wherein the molten metal comprises at least one of a Ti6Al4V alloy and a SS17-4 stainless steel alloy.

5. The method of claim 1, further comprising:

keeping a flask for holding the casting mold at a temperature above about 780° C. before injecting molten metal into the casting mold.

6. The method of claim 5, wherein the step of keeping the flask at the temperature includes subjecting the flask to a temperature between about 870° C. and about 1000° C.

7. The method of claim 1, further comprising:

forming the casting mold with a mold-forming slurry comprising a surfactant solution having a volume percentage of surfactant in a range from about 0.9% to about 4.5% per volume of water.

8. The method of claim 7, wherein the mold-forming slurry further comprises a powder, a volume ratio of water to powder in the mold-forming slurry being in a range from about 26 parts to about 30 parts of water for every 100 parts of powder.

9. The method of claim 8, wherein the mold-forming slurry comprises at least one of aluminum oxide and silicon oxide.

10. The method of claim 1, further comprising:

contacting a surface of a casting tree with a surfactant to wet the surface; and forming the casting mold with mold-forming slurry by contacting the mold-forming slurry with the wetted surface of the casting tree to improve surface finish of the casting mold product pattern surface relative to not wetting the casting tree surface.

11. The method of claim 10, wherein the surfactant is present in an aqueous solution.

12. The method of claim 1, wherein the at least one cast object is characterized by a Ra value below about 100.

13. The method of claim 1, wherein the at least one cast object has a major axis length less than about 0.3 inches.

14. A method of forming a cast portion of a medical device, comprising:

injecting reactive molten metal into a fluid-entry end of a sprue of a casting mold using centrifugation, the sprue being in fluid communication with at least one side runner, the reactive molten metal being at an elevated temperature such that the reactive molten metal can undergo reactions at a surface of the sprue;

impacting at least a portion of the reactive molten metal against a closed end of the sprue;

cooling the reactive molten metal to reduce the tendency to undergo reactions at the surface of the at least one side runner of the casting mold; and backfilling the at least one side runner with molten metal to form at least one cast object, the at least one side runner includes a major axis angled closer to the fluid-entry end than the closed end, wherein the at least one cast object has a smoother surface finish relative to a cast object formed from reactive molten metal at the elevated temperature.

15. The method of claim 14, wherein the step of impacting comprises reacting molten metal with at least a portion of a surface of the sprue.

16. The method of claim 14, wherein the molten metal comprises at least one of a stainless steel and a titanium alloy.

17. The method of claim 16, wherein the molten metal comprises at least one of a Ti6Al4V alloy and a SS17-4 stainless steel alloy.

18. The method of claim 14, further comprising:

keeping a flask for holding the casting mold at a temperature above about 780° C. before injecting molten metal into the casting mold.

19. The method of claim 14, wherein the at least one cast object is characterized by a Ra value below about 100.

* * * * *